US011634974B2

(12) United States Patent
Zachariah et al.

(10) Patent No.: US 11,634,974 B2
(45) Date of Patent: Apr. 25, 2023

(54) VALVE APPARATUS FOR INFLOW CONTROL DEVICES

(71) Applicant: Halliburton Energy Services, Inc., Houston, TX (US)

(72) Inventors: Jacob Zachariah, Singapore (SG); Thomas Frosell, Dallas, TX (US); Ryan Wesley McChesney, Prosper, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/635,139

(22) PCT Filed: Apr. 15, 2019

(86) PCT No.: PCT/US2019/027435
§ 371 (c)(1),
(2) Date: Jan. 29, 2020

(87) PCT Pub. No.: WO2020/214138
PCT Pub. Date: Oct. 22, 2020

(65) Prior Publication Data

US 2021/0254440 A1 Aug. 19, 2021

(51) Int. Cl.
*E21B 43/12* (2006.01)
*E21B 34/06* (2006.01)

(52) U.S. Cl.
CPC ..... *E21B 43/12* (2013.01); *E21B 34/063* (2013.01)

(58) Field of Classification Search
CPC ..... E21B 34/12; E21B 34/14; E21B 34/08; E21B 34/063; E21B 43/08; E21B 43/12
See application file for complete search history.

(56) References Cited

U.S. PATENT DOCUMENTS

| | | | | |
|---|---|---|---|---|
| 4,624,316 | A * | 11/1986 | Baldridge | E21B 21/10 137/515 |
| 5,881,686 | A | 3/1999 | Schmidt | |
| 9,151,143 | B2 * | 10/2015 | Holderman | E21B 34/06 |
| 2008/0041580 | A1 * | 2/2008 | Freyer | E21B 43/12 166/193 |
| 2011/0198097 | A1 * | 8/2011 | Moen | E21B 34/08 166/373 |
| 2011/0253391 | A1 * | 10/2011 | Veit | E21B 34/08 166/386 |
| 2017/0271188 | A1 * | 9/2017 | Fuller | H01L 21/67379 |

* cited by examiner

*Primary Examiner* — Christopher J Sebesta
(74) *Attorney, Agent, or Firm* — Scott Richardson; Parker Justiss, P.C.

(57) ABSTRACT

A valve useful in an inflow control device for downhole use in an oil and gas well completion equipment is disclosed. The valve may have a flexible canopy that prevents fluid flow between the base pipe and the formation when flow travels in a first direction and permits fluid flow between the base pipe and the formation when flow travels in a second direction.

15 Claims, 6 Drawing Sheets

VALVE APPARATUS FOR INFLOW CONTROL DEVICES

TECHNICAL FIELD

The exemplary embodiments disclosed herein relate generally to valves useful in inflow control devices and similar equipment used in the completion of oil and gas wells, and more particularly to valves used to restrict the flow of formation fluid in such devices.

BACKGROUND

The oil and gas industry has greatly increased hydrocarbon reserves and increased oil production through the use of techniques such as horizontal drilling. These techniques can increase the amount of reservoir contacted by the wellbore, which can improve well productivity. Horizontal wells offer greater reservoir contact than vertical wells and can produce more hydrocarbons with less drawdown pressure along the wellbore. However, they may suffer uneven production because of issues such as reservoir heterogeneity or variations in permeability along the length of the wellbore. This can lead to problems, such as water influx and an unwanted increase in sand production. Therefore, the completion equipment of such oil and gas wells must have the ability of control the flow into and out of the reservoir through flow control ports formed in the equipment.

It is desirable to exclude, or at least substantially reduce, the production of water from a well that is intended for hydrocarbon production. For example, it is very desirable for the fluid which is produced from the well to have a relatively high proportion of hydrocarbons, and a relatively low proportion of water. In some cases, it is also desirable to restrict the production of hydrocarbon gas from a well.

In addition, where fluid is produced from a long interval of a formation penetrated by a wellbore, it is known that balancing the production of fluid along the interval can lead to reduced water and gas coning, and more controlled conformance, thereby increasing the proportion and overall quantity of oil produced from the interval. Inflow control devices (ICDs) have been used in conjunction with well screens in the past to restrict flow of produced fluid through the screens for this purpose of balancing production along an interval. For example, in a long horizontal wellbore, fluid flow near a heel of the wellbore may be more restricted as compared to fluid flow near a toe of the wellbore, to thereby balance production along the wellbore.

To allow flow from the formation through the ICD and into the production tubing, the ICD is provided with various flow passageways and openings, or ports, leading to the interior bore of a base pipe that is in fluid communication with the production tubing. To perform downhole operations with the ICD in place (e.g., setting packers, washpipe free mechanisms, water injection capability without any cross flow between zones, etc.), there is a need to control the flow of fluids through such passageways and ports. AICDs, ICDs and other downhole devices may have open ports through which flow can occur in both directions when the device is run down into the well or during the early production stage or during the production phase. Thus, further advancements are needed in the art of reducing production of undesired fluids from hydrocarbon wells, in part due to the difficulties and costs associated with separating the undesired fluids from the desired fluids at the surface and then disposing of the undesired fluids.

BRIEF DESCRIPTION OF THE DRAWINGS

For a more complete understanding of the exemplary disclosed embodiments, and for further advantages thereof, reference is now made to the following description taken in conjunction with the accompanying drawings in which.

DESCRIPTION OF EXEMPLARY EMBODIMENTS

Figure 1:
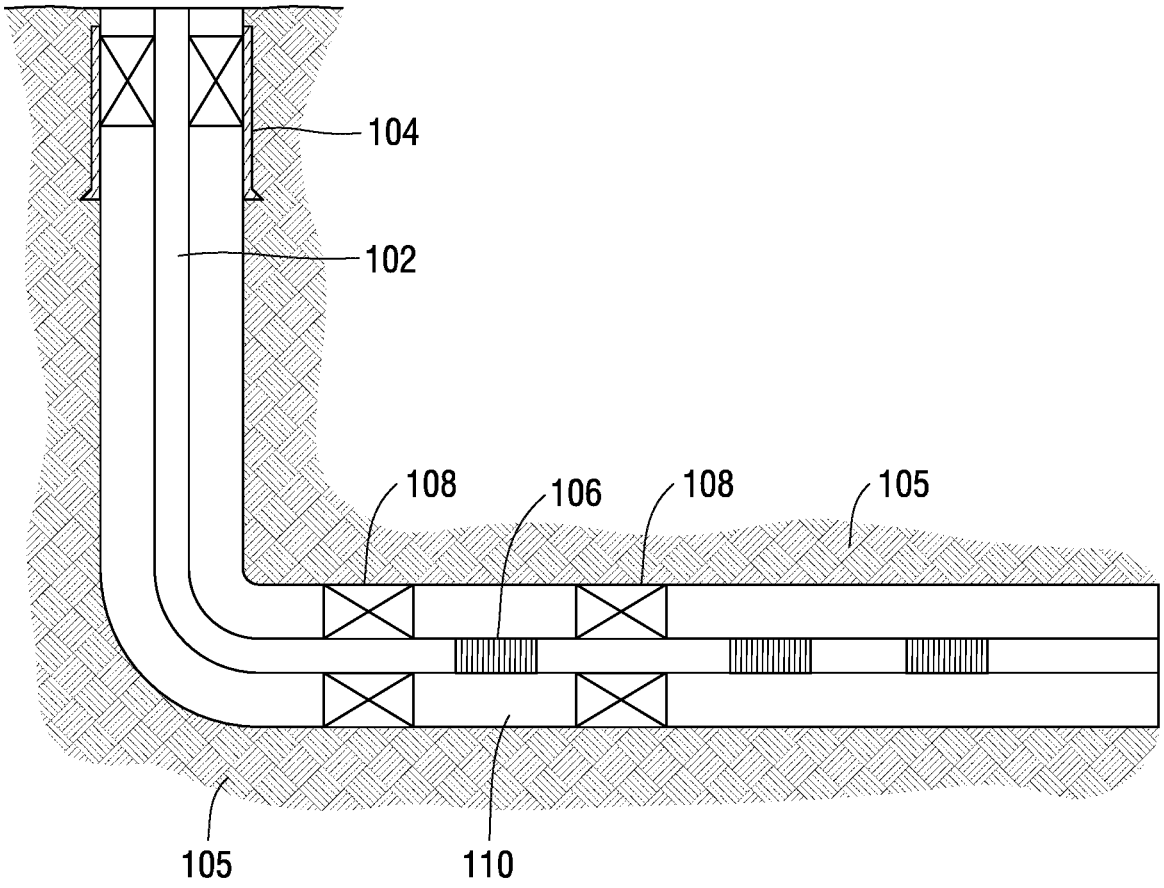
FIG. 1 is a schematic diagram of a well system useful with an AICD unit according to an embodiment of the invention.

The following discussion is presented to enable a person ordinarily skilled in the art to synthesize and use the exemplary disclosed embodiments. Various modifications will be readily apparent to those skilled in the art, and the general principles described herein may be applied to embodiments and applications other than those detailed below without departing from the spirit and scope of the disclosed embodiments as defined herein. Accordingly, the disclosed embodiments are not intended to be limited to the particular embodiments shown, but are to be accorded the widest scope consistent with the principles and features disclosed herein.

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings.

Downhole completion of oil and gas wells typically requires equipment to be located downhole in the hydrocarbon producing formations to control the flow of production fluid into the production tubing. One example of a device for controlling production flow is an inflow control device ("ICD"). An ICD is a device that may be used in the completion hardware of an oil and gas well to assist in the even distribution of hydrocarbon from the wellbore. Typically, an ICD restricts flow by creating additional pressure drop to equalize reservoir inflow along the length of the wellbore. Multiple inflow control devices may be used in a reservoir section. A more evenly distributed flow profile may optimize production and reduce problems related to drawdown or water or sand production. ICDs are generally passive and cannot be adjusted after they are installed. If water or gas breaks through in one part of the wellbore, a conventional ICD may not be able counter the effects of the higher mobility of these fluids in the reservoir. An autonomous inflow control device ("AICD") is a self-regulating flow control device that can change the amount of flow restriction depending on the properties of the fluid flowing through it. This allows an AICD to restrict water and gas more than oil.

The embodiments disclosed herein relate to a directional or "umbrella valve" mechanism that is used in the system to create a seal to restrict any flow through the ports in one direction. Based on the need, the flow restriction can be in the injection direction or the production direction by arranging the valve accordingly in a valve block. For a valve with flow restriction towards the injection direction, for example, any flow from the tubing to the formation will be prevented. But when flow occurs in production direction, the valve will open to create a flow path. The reverse would be true for a valve arrange to prevent flow in the production direction. The directional seal feature can be added to, or removed from, a particular piece of equipment based on the production needs of a well. This provides adjustable capability according to embodiments of the invention.

In more specific embodiments, an AICD, ICD or any similar downhole assembly that requires a fluid flow port, a directional valve feature can be introduced to create a seal which helps to restrict any flow in a particular direction and allow flow in opposite direction. One embodiment of the invention provides a valve having a canopy or "umbrella" section. When pressure is applied to the exterior canopy section of the valve, the canopy section will flex against the surface of a valve block arranged in a flow passageway, which results in creating a sealed condition. When there is higher flow against the sealed direction, pressure will act against the valve and thus create a bend/lift of the umbrella section (i.e., the canopy section is bent outward) which leads to the opening of the ports. This embodiment provides and efficient and cost-effective solution to providing a one way flow requirement.

Referring now to FIG. 1, a partial view of a well system 100 is shown in which an ICD according to the embodiments disclosed herein may be used. The well 100, which may be an offshore well, an onshore well, a vertical well, a horizontal well, a deviated well, and the like, includes a tubing string 102 that has been conveyed into a casing 104 within a subterranean formation 105. The tubing string 102 includes an ICD 106 and packers 108 positioned downhole with the ICD 106. The packers 108 isolate an annulus 110 formed between the tubing string 102 and the formation 105. Flow of hydrocarbon containing fluid from the formation travels through flow passageways in the ICD as will be further described herein. In other embodiments, multiple ICDs, packers, and other completion equipment may be provided in the wellbore.

Figure 2A:
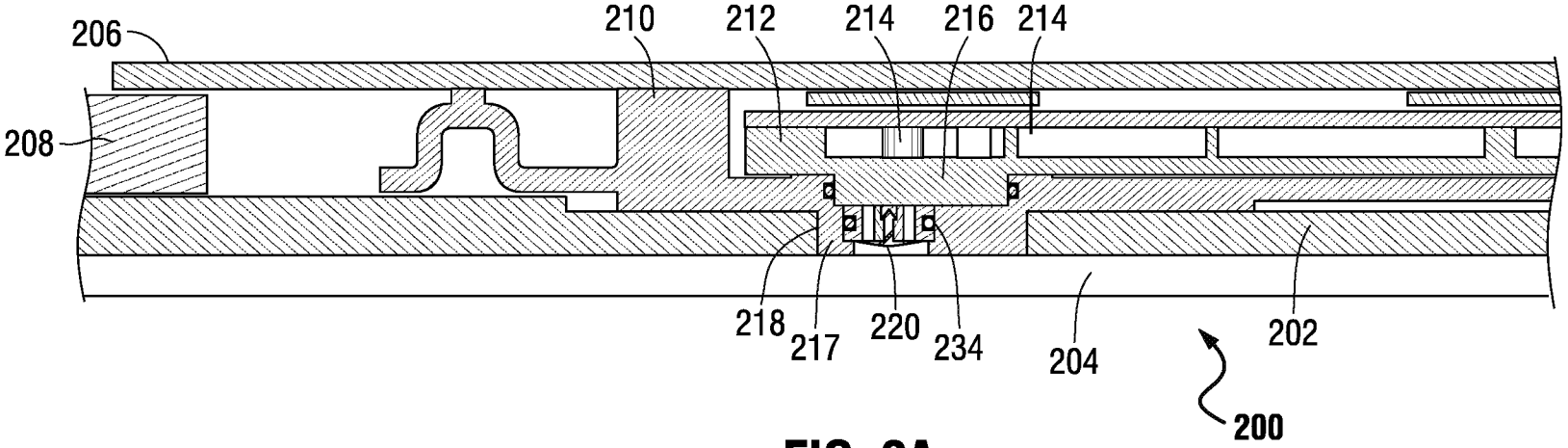
FIG. 2A-2E are schematic diagrams of a AICD unit having a valve according to an embodiment of the invention.

FIG. 2A schematically depicts an AICD 200 having a directional flow valve according to an embodiment of the invention. The AICD 200 includes a base pipe 202 having a central bore or fluid flow passage 204. The fluid flow passage 204 allows production fluids to flow from the formation up to the surface of the well site. Additionally, the fluid flow passage 204 allows fluids to be pumped from the surface down through the base pipe 202 in order to perform various operations, such as creating pressure to set packers.

An outer housing 206 is circumferentially arranged around base pipe 202. The outer housing 206 is connected to the base pipe 202 by ring members 208. Flow control assembly 210 is provided on the exterior surface of base pipe 202. Flow control assembly 210 includes AICD vortex assembly 212. The vortex assembly 212 is provided with a system of fluid flow channels 214 formed on to its surface that control the flow of formation fluid coming from the hydrocarbon bearing formation. The fluid flow channels 214 in the vortex assembly 212 are arranged to create a flow restriction of the formation fluids that increases the production of hydrocarbons. For example, because the formation fluids may contain water in addition to oil, the fluid flow channels 214 are arranged such that the more viscous oil takes a shorter flow path to an opening 216 in the vortex assembly 212.

Vortex opening 216 connects to a nozzle 217 in flow control assembly 210 allows fluid passage through base pipe lateral opening 218 and into the central bore 204 of base pipe 202. Flow between the vortex assembly 212 and the central bore 204 of the base pipe 202 passes through directional valve 220. Directional valve 220 is shown in the closed position in FIG. 2A, and it is arranged so that fluid in the central bore 204 of base pipe 202 is prevented from flowing into the vortex assembly 212 and potentially into the formation.

Figure 2B:
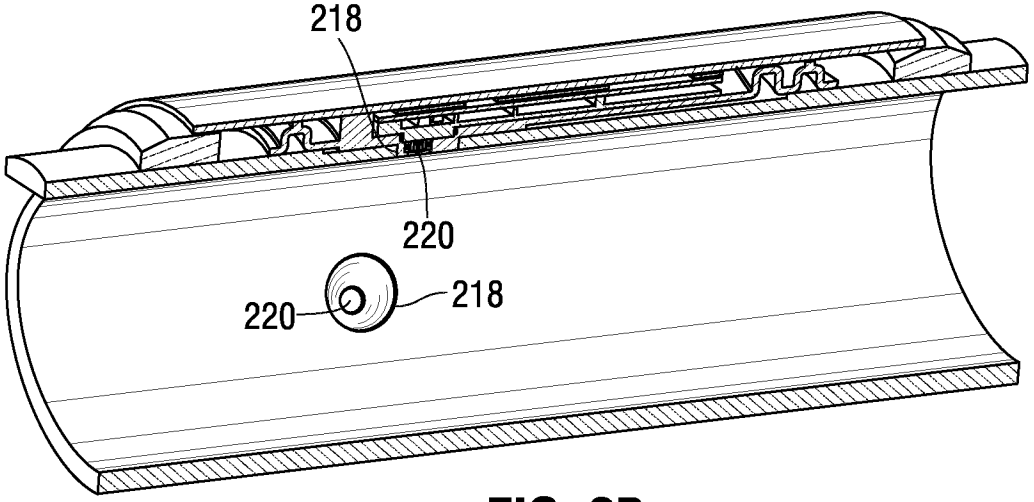

FIG. 2B is cutaway view of the AICD 200 showing a plurality of directional valves 220 installed in a plurality of openings 218 in the base pipe. A person of skill in the art would understand that any number of valves could be installed into the base pipe according to embodiments of the invention as a matter of design choice.

Figure 2C:
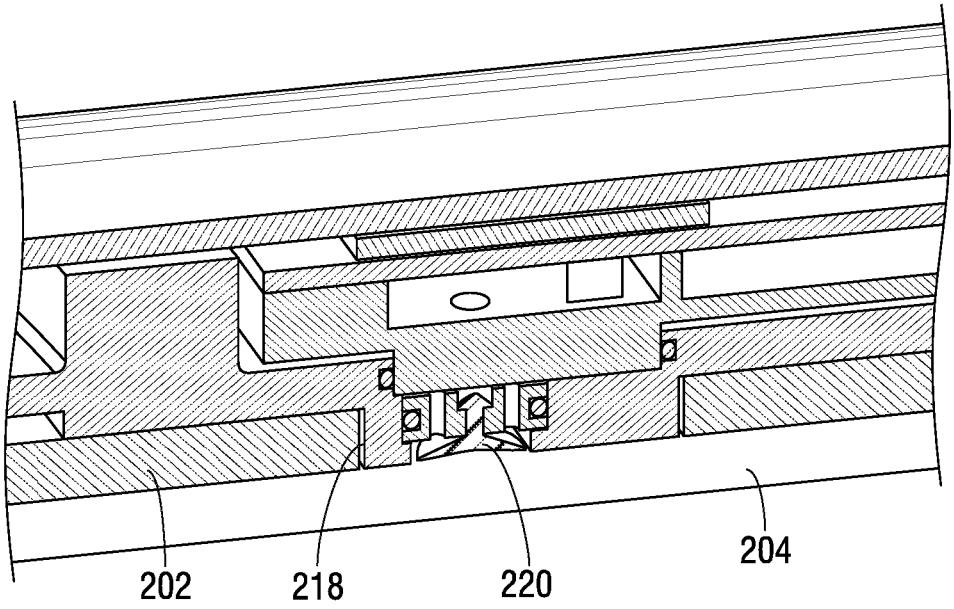

FIG. 2C is a schematic view of an AICD 200 according to an embodiment of the invention with directional valve 220 in the open position. In the open position, in this arrangement, fluid may flow from the vortex assembly 212 through the opening 218 in base pipe 202 via directional valve 220. These fluids may then be produced to the surface of the formation through the central bore 204.

It will be appreciated by those skilled in the art that the flow direction permitted by directional valve 220 could be reversed as a matter of design choice by reversing the arrangement of the valve. In other words, the valve could be positioned such that fluid flow is prevented from the vortex assembly 212 into the central bore 204 of the base pipe 202, and permitted from the central bore 204 through the directional valve 220 and into the vortex assembly 212. This arrangement may be useful in certain operations, such as inflating packer assemblies.

Figure 2D:
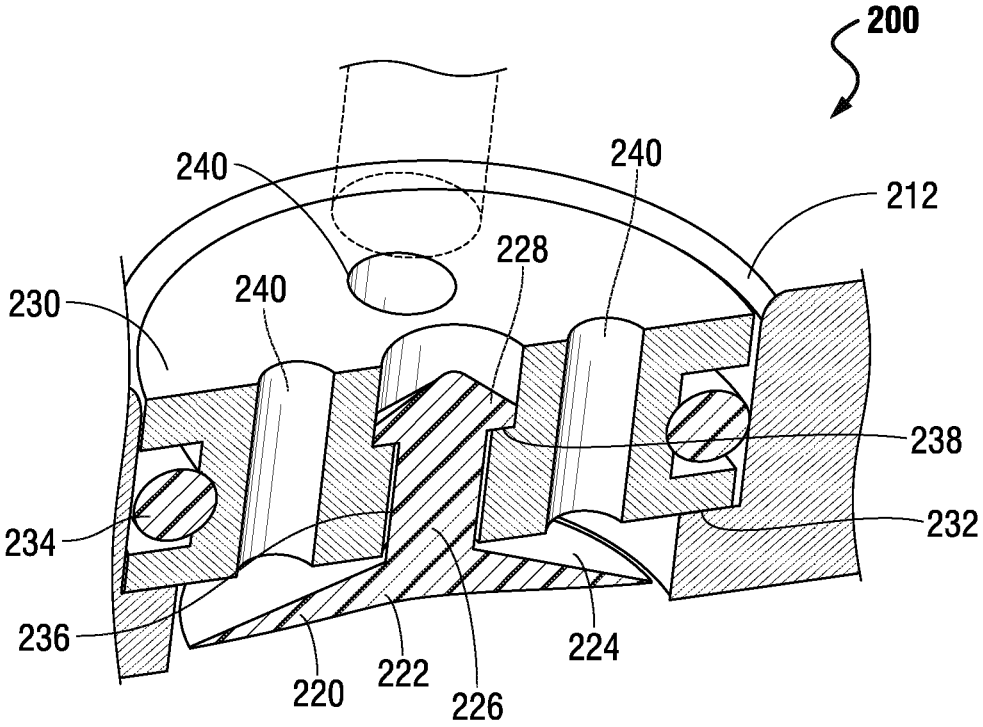

FIG. 2D is a schematic drawing illustrating a directional valve 220 according to an embodiment of the invention. The directional valve 220 is in the general shape of, and may be referred to, as an umbrella valve. The umbrella valve 220 is preferably made from a suitable elastomer that allows it to flex back and forth between the open and closed positions. It will also be understood that suitable elastomers will also be able to withstand the temperatures and pressures in downhole environments. In one embodiment, the umbrella valve 220 is formed as a unitary elastomeric member.

In another embodiment, the umbrella valve 220 may be constructed from a dissolvable material. The umbrella valve 220 will dissolve when a suitable dissolving solution is pumped downhole through the central bore 204 of the base pipe 202 and comes into contact with the umbrella valve 220. This embodiment allows for the umbrella valve 220 to operate for certain periods of time. For example, the umbrella valve 200 may act to prevent any pressure or flow from going through the ports in the base pipe 202 during operations like packer setting or washpipe free operations. At the end of the operation, the umbrella valve 220 can be dissolved and bi-directional flow of fluid would be permitted through the base pipe openings 218.

Still with reference to the embodiment depicted in FIG. 2D, the umbrella valve 220 comprises a valve canopy 222 having a valve face surface 224. The valve 220 further comprises a valve stem 226 which terminates in valve retention member 228. Valve 220 is arranged within valve block 230. Valve block 230 may be secured in a port in vortex assembly 212 which may be further arranged in an opening 218 in the base pipe 202 as illustrated in FIG. 2A.

The valve block 230 is arranged to rest on valve block seat 232 formed in the vortex assembly 212. Undesired fluid flow around the valve block 230, which could result in unwanted fluid communication between the base pipe 202 and the vortex assembly 212, is prevented by O-ring 234.

The umbrella valve 220 may be installed in valve block 230 by inserting the stem 226 and retaining member 228 through a central hole 236 in the block 230. Central hole 236 has a retaining member seating portion 238, which holds the umbrella valve 220 securely in place. Because the umbrella valve 220 is made from a flexible elastomer, in this embodiment, when it is inserted into central hole 236, the retention member 228 expands to seat firmly against seating section 238. Forming the retention member 228 from elastomeric material advantageously allows the valve to be easily removable if desired.

In another embodiment, the retention member 228 is arranged so that the valve may also be removed from valve block 230. This allows an AICD or ICD according to embodiments of the invention to be adjustable so that the valve 220 can be added or removed by an operator as needed for a particular application.

Valve block 230 is also provided with fluid passages 240. In this embodiment, valve block has four fluid passages that allow fluid passage between vortex assembly 212 and base pipe 202. Valve 220 in the embodiment shown in FIG. 2D allows fluid to flow only in one direction, from the formation into the base pipe 202. When fluid flows from the vortex assembly 212 through fluid passages 240, the sealing face 224 of the valve canopy 222 is forced away from the valve block 230 by the fluid pressure. This allows fluid flow from the vortex assembly 212 into the base pipe opening 218 and into the central bore of the base pipe 202. Hydrocarbon containing fluids from the formation can, in this way, be produced to the surface.

By contrast, when fluid pressure in the base pipe 202 increases above formation pressure, valve 220 closes against the valve block 230 and prevents fluid flow that could travel into the formation.

Figure 2E:
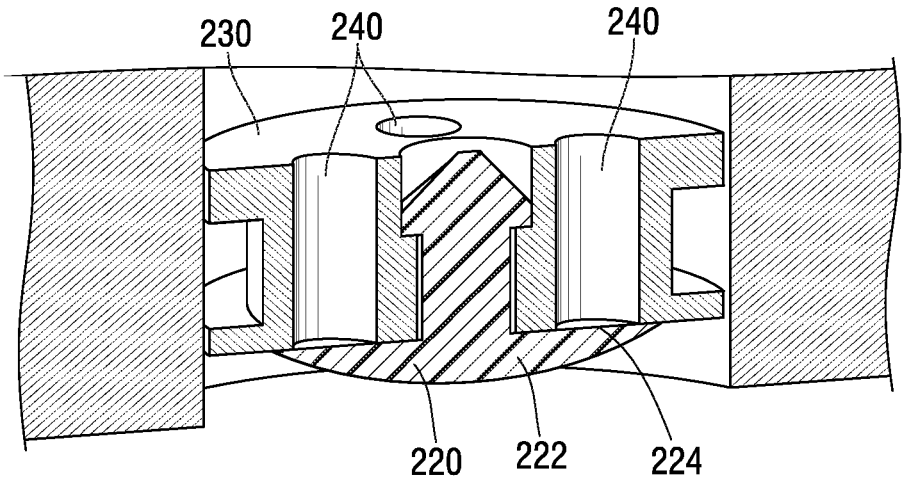

FIG. 2E shows an exemplary umbrella valve 220 in the closed position. In this case, fluid pressure in the base pipe has caused the valve canopy 222 to flex toward the valve block 230. The sealing face 224 is pressed firmly against the valve block 230 and completely covers fluid passages 240 preventing fluid flow from the base pipe into the vortex assembly.

Figure 3A:
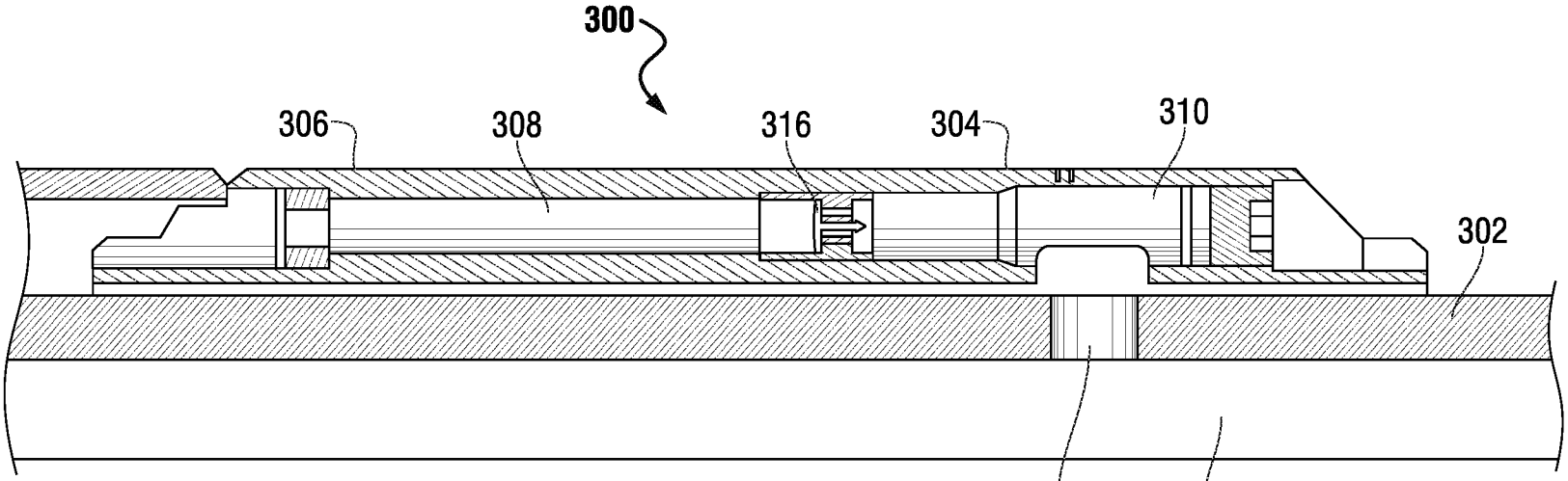
FIG. 3A-3B are schematic diagram of an ICD with a valve according to an embodiment of the invention.

FIG. 3A shows a further embodiment in which an exemplary umbrella valve is used with an ICD unit 300. In the embodiment shown, the valve 316 is arranged to prevent any production fluid from the formation from flowing into the base pipe 302. This embodiment is useful in applications involving, for instance, water injection. The ICD 300 includes the base pipe 302 with circumferentially attached flow control device 304. Flow control device 304 comprises an outer housing 306 that contains fluid flow tubes 308 and 310 that permit fluid communication between the hydrocarbon producing formation and the central bore 312 of the base pipe 302 through a port or opening 314 in the base pipe. Fluid flow tubes 308 and 310 are separated by umbrella valve 316, which, in this embodiment, only allows flow from the base pipe 302 to the formation. It will be appreciated that the direction of the umbrella valve 316 can be reversed to act as an injection restrictor.

Figure 3B:
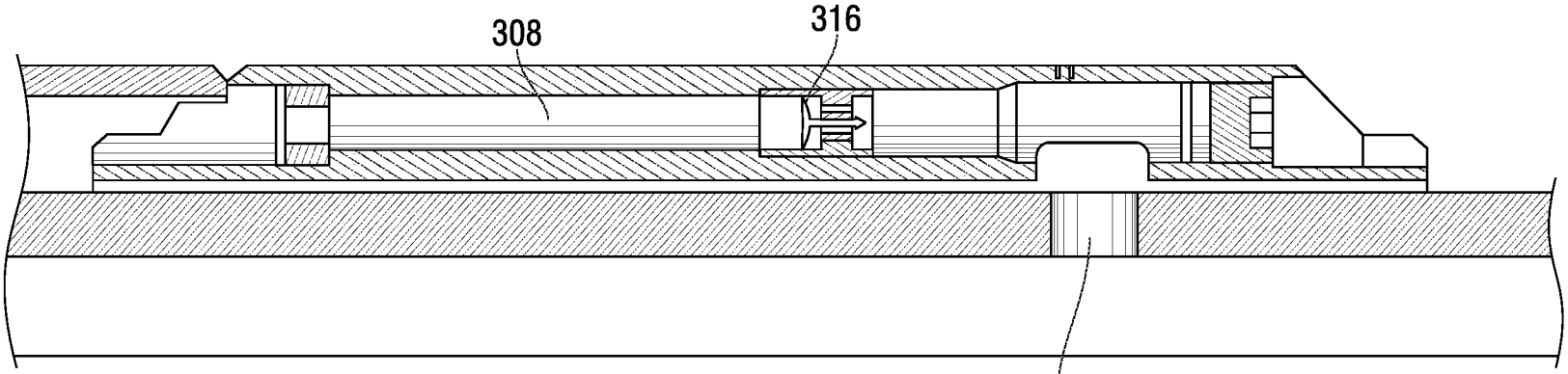

FIG. 3B shows umbrella valve 316 in the open condition, permitting fluid to flow from the lateral opening 314 in the base pipe 302 into fluid flow tube 308.

Figure 4:
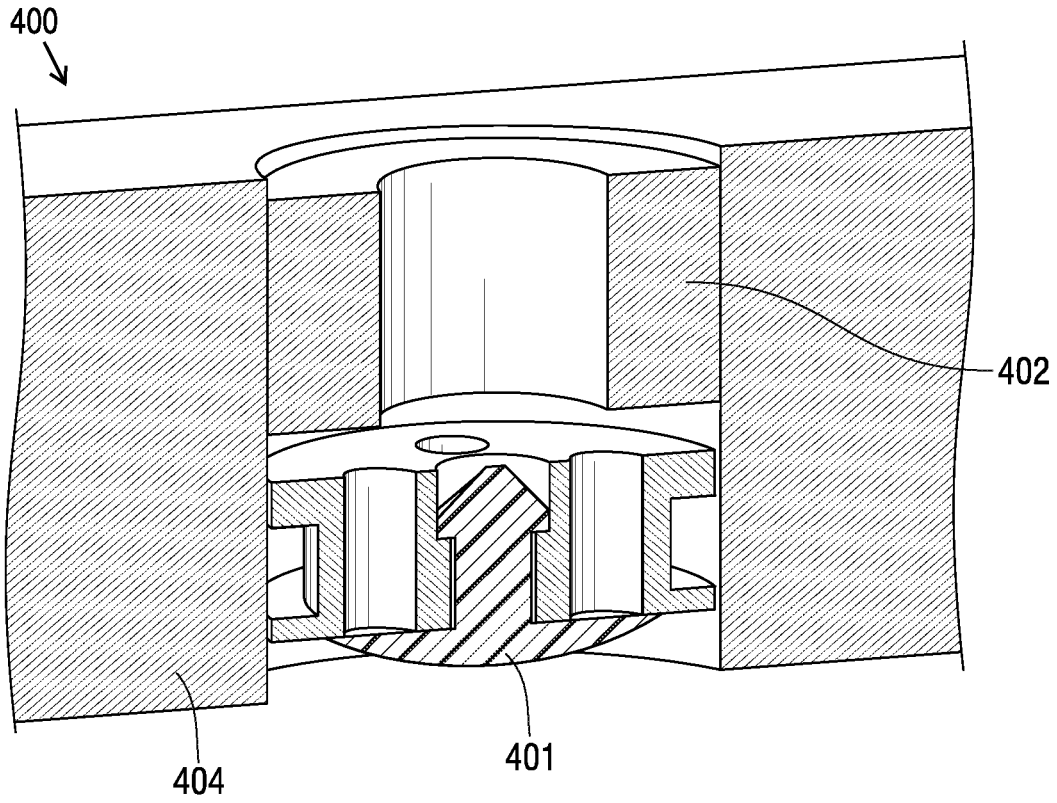
FIG. 4 is a schematic diagram of a valve fitted into a port of an ICD according to an embodiment of the invention.

FIG. 4 shows still a further embodiment of the invention useful in an ICD unit 400. In this case exemplary valve 401 is used with ICD/flow restrictor 402 fitted radially in the wall of the base pipe 404 to prevent any injection flow in washpipe free, tube plugging situations or, for example, creating pressure for packer setting etc. The direction of the umbrella valve 401 can be reversed to act as production restrictor in other advantageous oilfield operations such as water injection.

It will be appreciated by those of skill in the art that embodiments of the invention are not limited to AICD and ICD units, but may also be used in other suitable downhole situations in the oil and gas industry.

For example, a valve according to an embodiment of the invention may be used for producing hydrocarbons from an oil and gas well in a situations having a washpipe free requirement. It will also be appreciated that an exemplary umbrella valve may also be operated to act as a production restrictor. For example, in enhanced oil recovery (EOR) techniques water injection or water flooding helps to improve the amount of formation fluid being recovered from a well. In this process, injected water or brine or some other solution helps to increase the depleted well pressure and thus results in increasing the well pressure sufficient for the production. In an embodiment, a method is provided for producing hydrocarbons from an oil and gas in an EOR technique is provided to prevent any production flow without restricting the injection flow. In this application, the umbrella valve feature will make sure that the injected fluid will not escape from the formation region. This ensures that cross flow between zones will not occur during the injection process and thus avoids any pressure loss. This helps prolong the life of the production well with less cost intervention.

Accordingly, as set forth above, embodiments disclosed herein may be implemented in a number of ways. For example, in general, in one aspect, the disclosed embodiments relate to a valve for use in downhole completion equipment. The valve comprises, among other things, a valve stem, a valve retention feature at a first proximate end of the valve stem, and a flexible valve canopy at a second end of the valve stem, the canopy having a fluid sealing surface.

In accordance with one or more embodiments of the valve, the valve comprises an elastomer material and/or a dissolvable elastomer material, the valve retention feature is integrally formed of elastomer material at the first proximate end of the valve stem, and/or the fluid sealing surface of the canopy prevents fluid flow through a fluid passageway when fluid flows in a first direction and permits fluid flow through the passageway when fluid flows in a second direction.

In general, in another aspect, the disclosed embodiments relate to a valve assembly for use in downhole completion equipment. The completion equipment comprises, among other things, a valve block having at least one fluid passage opening and a valve stem opening, a valve having a valve stem, a valve retention feature at a first proximate end of the valve stem, and a flexible valve canopy at a second end of the valve stem, the canopy having a fluid sealing surface. The valve stem is arranged in the valve stem opening of the valve assembly and the fluid sealing surface covers the at least one fluid passage opening to prevent fluid flow when fluid flows in a first direction through the at least one fluid passage opening and uncovers the at least one fluid passage opening when fluid flows in a second direction.

In accordance with one or more embodiments of the valve assembly, the valve comprises an elastomer material and/or a dissolvable elastomer material, the valve retention member comprises an elastomer material that engages a seating surface in the valve stem opening, and/or the valve is made entirely of an integral elastomer material.

In general, in yet another aspect, the disclosed embodiments relate to an inflow control device for use in downhole completion equipment. The completion equipment comprises a base pipe having an interior and at least one fluid flow port, an outer housing arranged on the base pipe, a fluid flow control assembly arranged within the outer housing having a fluid flow passage way that permits the flow of hydrocarbon containing fluid from an oil-bearing subterranean formation to the interior of the base pipe through the at least one fluid flow port, and a valve arranged in the fluid flow passage way capable of restricting the flow of fluid from the subterranean formation to the interior of the base pipe, the valve having a flexible canopy that prevents fluid flow between the base pipe and the formation when flow travels in a first direction and permits fluid flow between the base pipe and the formation when flow travels in a second direction.

In accordance with one or more embodiments of the inflow control device, the valve is arranged in a valve block having at least one opening that may be sealed by the flexible canopy to prevent fluid flow through the fluid flow passage way or unsealed by the flexible canopy depending on the direction of fluid flow, the valve further comprises a stem having a retention member that engages with a seat in the valve block, the valve comprises an elastomer and/or a dissolvable elastomer.

In general, in still another aspect, the disclosed embodiments relate to a well system. The well system comprises, among other things, production tubing string, a wellbore having a substantially horizontal section, and at least one well screen assembly interconnected in the tubular string and positioned in the horizontal section of the wellbore, an uncased section in the horizontal section of the wellbore, and at least one packer for isolating a fluid production zone of the wellbore. The well system further comprises an inflow control device for downhole use in an oil and gas well, the inflow control device including a base pipe having an interior and at least one fluid flow port, an outer housing arranged on the base pipe, a fluid flow control assembly arranged within the outer housing having a fluid flow passage way that permits the flow of hydrocarbon containing fluid from an oil-bearing subterranean formation to the interior of the base pipe through the at least one fluid flow port, and a valve arranged in the fluid flow passage way capable of restricting the flow of fluid from the subterranean formation to the interior of the base pipe, the valve having a flexible canopy that prevents fluid flow between the base pipe and the formation when flow travels in a first direction and permits fluid flow between the base pipe and the formation when flow travels in a second direction.

In accordance with one or more embodiments of the well system, the valve is arranged in a valve block having at least one opening that may be sealed by the flexible canopy to prevent fluid flow through the fluid flow passage way or unsealed by the flexible canopy depending on the direction of fluid flow, the valve further comprises a stem having a retention member that engages with a seat in the valve block, and the valve comprises an elastomer and/or a dissolvable elastomer.

While the invention has been described with reference to one or more particular embodiments, those skilled in the art will recognize that many changes may be made thereto without departing from the spirit and scope of the description. Each of these embodiments and obvious variations thereof is contemplated as falling within the spirit and scope of the claimed invention, which is set forth in the following claims.

What is claimed is:

1. A valve assembly for use in downhole completion equipment comprising:

a valve block having at least one fluid passage opening and a valve stem opening; and a valve having a valve stem, a valve retention member at a first proximate end of the valve stem, and a flexible valve canopy at a second end of the valve stem, the canopy having a fluid sealing surface;

wherein the valve stem is arranged in the valve stem opening of the valve block and the fluid sealing surface covers the at least one fluid passage opening to prevent fluid flow when fluid flows in a first direction through the at least one fluid passage opening and uncovers the at least one fluid passage opening when fluid flows in a second direction, the valve operable to be removed from the valve stem opening while the valve assembly is downhole, to provide bidirectional flow.

2. A valve assembly as in claim 1 wherein the valve comprises an elastomer material.

3. A valve assembly as in claim 2 wherein the valve comprises a dissolvable elastomer material.

4. A valve assembly as in claim 1 wherein the valve retention member comprises an elastomer material that engages a seating surface in the valve stem opening.

5. A valve assembly as in claim 1 wherein the valve is made entirely of an integral elastomer material.

6. An inflow control device for use in downhole completion equipment comprising:

a base pipe having an interior and at least one fluid flow port;

an outer housing arranged on the base pipe;

a fluid flow control assembly arranged within the outer housing having a fluid flow passage way that permits the flow of hydrocarbon containing fluid from an oil-bearing subterranean formation to the interior of the base pipe through the at least one fluid flow port; and a valve arranged in the fluid flow passage way capable of restricting the flow of fluid from the subterranean formation to the interior of the base pipe, the valve having a flexible canopy that prevents fluid flow between the base pipe and the formation when flow travels in a first direction and permits fluid flow between the base pipe and the formation when flow travels in a second direction, the valve operable to be removed from the fluid flow passage way while the inflow control device is downhole, to provide bidirectional flow.

7. An inflow control device as in claim 6 wherein the valve is arranged in a valve block having at least one opening that may be sealed by the flexible canopy to prevent fluid flow through the fluid flow passage way or unsealed by the flexible canopy depending on the direction of fluid flow.

8. An inflow control device as in claim 7 wherein the valve further comprises a stem having a retention member that engages with a seat in the valve block.

9. An inflow control device as in claim 7 wherein the valve comprises an elastomer.

10. An inflow control device as in claim 7 wherein the valve comprises a dissolvable elastomer.

11. A well system comprising:

a production tubing string;

a wellbore having a substantially horizontal section;

at least one well screen assembly interconnected in the tubular string and positioned in the horizontal section of the wellbore;

an uncased section in the horizontal section of the wellbore;

at least one packer for isolating a fluid production zone of the wellbore;

an inflow control device for downhole use in an oil and gas well, the inflow control device including a base pipe having an interior and at least one fluid flow port;

an outer housing arranged on the base pipe;

a fluid flow control assembly arranged within the outer housing having a fluid flow passage way that permits the flow of hydrocarbon containing fluid from an oil-bearing subterranean formation to the interior of the base pipe through the at least one fluid flow port; and a valve arranged in the fluid flow passage way capable of restricting the flow of fluid from the subterranean formation to the interior of the base pipe, the valve having a flexible canopy that prevents fluid flow between the base pipe and the formation when flow travels in a first direction and permits fluid flow between the base pipe and the formation when flow travels in a second direction.

12. A well system as in claim 11 wherein the valve is arranged in a valve block having at least one opening that may be sealed by the flexible canopy to prevent fluid flow through the fluid flow passage way or unsealed by the flexible canopy depending on the direction of fluid flow.

13. A well system as in claim 11 wherein the valve further comprises a stem having a retention member that engages with a seat in the valve block.

14. A well system as in claim 11 wherein the valve comprises an elastomer.

15. A well system as in claim 14 wherein the valve comprises a dissolvable elastomer.

* * * * *